US007303021B2

(12) United States Patent
Schats et al.

(10) Patent No.: US 7,303,021 B2
(45) Date of Patent: Dec. 4, 2007

(54) WELLBORE RIG ELEVATOR SYSTEMS

(75) Inventors: Mike Schats, Eindhoven (NL); Bob DePont, Dongen (NL); Pieter Dekker, Baarland (NL); Anton Krijnen, Klundert (NL)

(73) Assignee: Varco I/P, Inc., Houston, TX (US)

( * ) Notice: Subject to any disclaimer, the term of this patent is extended or adjusted under 35 U.S.C. 154(b) by 198 days.

(21) Appl. No.: 11/231,290

(22) Filed: Sep. 20, 2005

(65) Prior Publication Data

US 2007/0062705 A1 Mar. 22, 2007

(51) Int. Cl.
*E21B 19/06* (2006.01)

(52) U.S. Cl. ..... 166/379; 166/380; 166/77.52

(58) Field of Classification Search ..... 166/379, 166/380, 77.52, 77.51; 175/423; 294/102.2, 294/90, 91, 110.1
See application file for complete search history.

(56) References Cited

U.S. PATENT DOCUMENTS

| | | | | |
|---|---|---|---|---|
| 1,021,984 | A | 4/1912 | Holmes | 294/90 |
| 1,113,659 | A | 10/1914 | Lebus | 166/77.52 |
| 1,371,835 | A | 3/1921 | Angus | 294/90 |
| 1,448,100 | A | 3/1923 | Wigle | |
| 1,599,144 | A | 9/1926 | Paulsen | 294/90 |
| 1,756,376 | A | 4/1930 | Moore | |
| 1,779,895 | A | 10/1930 | White | |
| 1,814,407 | A | 7/1931 | Peebles | 294/90 |
| 1,842,638 | A | 1/1932 | Wigle | |
| 1,844,379 | A | 2/1932 | Campbell | |
| 1,871,845 | A | 8/1932 | Grant | |
| 2,242,783 | A | 5/1941 | Grau | |
| 2,354,217 | A | 7/1944 | Mulllinix et al. | |
| 2,635,769 | A | 4/1953 | Cobb | 294/91 |
| 2,695,189 | A | 11/1954 | Chrisman et al. | 294/90 |
| 2,722,450 | A | 11/1955 | Nelson | 294/90 |
| 2,957,724 | A | 10/1960 | Bujold | |
| 3,140,523 | A | 7/1964 | Taylor, Jr. | |
| 3,193,116 | A | 7/1965 | Kenneday et al. | |
| 3,287,776 | A | 11/1966 | Brown | 294/90 X |
| 3,330,354 | A | 7/1967 | Chamblee | 166/313 |
| 3,368,699 | A | 2/1968 | Scaggs | |

(Continued)

FOREIGN PATENT DOCUMENTS

FR 1.247.617 12/1960

(Continued)

OTHER PUBLICATIONS

U.S. Appl. No. 08/49291, filed 1959, Estes.

(Continued)

*Primary Examiner*—David Bagnell
*Assistant Examiner*—David Andrews
(74) *Attorney, Agent, or Firm*—Guy McClung

(57) ABSTRACT

An elevator having, in at least certain aspects, an elevator body with two opposed ends and an elevator opening in the body, a door pivotably mounted to the body for selectively closing off the elevator opening, a lock bar on the elevator body, door latch apparatus on the door including a movable member to selectively and releasably hold the lockbar, and locking apparatus for selectively locking the door in position; and, in certain aspects, verification apparatus for maintaining the locking apparatus in position.

18 Claims, 9 Drawing Sheets

U.S. PATENT DOCUMENTS

| | | | | |
|---|---|---|---|---|
| 3,403,791 | A | 10/1968 | Marks et al. | |
| 3,461,666 | A | 8/1969 | Burstall | |
| 3,884,519 | A | 5/1975 | McFadden | 294/90 |
| 3,996,737 | A | 12/1976 | Burstall | 59/35 R |
| 4,042,123 | A | 8/1977 | Sheldon et al. | 214/2.5 |
| 4,126,348 | A | 11/1978 | Palmer | 294/88 |
| 4,354,706 | A | 10/1982 | Coyle, Sr. | 294/102 A |
| 4,396,216 | A | 8/1983 | Hamilton | 294/90 |
| 4,415,193 | A | 11/1983 | Carlberg | 294/102 A |
| 4,421,447 | A | 12/1983 | Gudgel et al. | 414/22 |
| 4,834,441 | A | 5/1989 | Schivley | 294/90 |
| 5,340,182 | A | 8/1994 | Busink et al. | 294/88 |
| 5,711,382 | A | 1/1998 | Hansen et al. | 175/52 |
| 5,755,289 | A | 5/1998 | Angman et al. | 166/378 |
| 5,794,314 | A | 8/1998 | Gamper et al. | 24/517 |
| 5,848,647 | A | 12/1998 | Webre et al. | 166/379 |
| 5,988,299 | A | 11/1999 | Hanssen et al. | 175/52 |
| 5,992,801 | A | 11/1999 | Torres | 248/49 |
| 6,056,060 | A | 5/2000 | Abrahamsen et al. | 166/380 |
| 6,073,699 | A | 6/2000 | Hollingsworth, Jr. | 166/379 |
| 6,227,587 | B1 | 5/2001 | Terral | 294/102.2 |
| 6,494,273 | B1 | 12/2002 | Martin | 175/220 |
| 6,520,709 | B1 | 2/2003 | Mosing et al. | 403/305 |
| 6,568,479 | B2 | 5/2003 | Mosing et al. | 166/380 |
| 6,571,667 | B2 | 6/2003 | Price et al. | 81/57.33 |
| 6,626,238 | B2 | 9/2003 | Hooper | 166/66 |
| 6,968,895 | B2 | 11/2005 | Mosing et al. | 166/77.52 |
| 2005/0000696 | A1 | 1/2005 | McDaniel et al. | 166/379 |

FOREIGN PATENT DOCUMENTS

| | | |
|---|---|---|
| GB | 249.807 | 12/1926 |
| GB | 249807 | 12/1926 |
| GB | 1271250 | 4/1972 |
| WO | WO 2005/106185 A1 | 8/2004 |

OTHER PUBLICATIONS

PCT/GB2006/050254: Invitation to Pay Additional Fees and Annex to Form PCT/ISA/206: 4 pp.: mailed Dec. 20, 2006.

Frank's Horseshoe Elevator: Frank's Casing Crew & Rental Tools, Inc.: 1 page: 2001.

Elevators, Varco: 1 page: Composite catalog 1986-87: 1986.

Catalog 1978-79: Joy Petroleum Equipment: cover page & pp. 33-43. 45-52: 1978.

BJ 1986-87 Oil Field Products and Systems: BJ Hughes Drilling Equipment: cover page. pp. 36, 37, 40-44 46-50, 53-55, 65, 70, 99-107; 1986.

Varco General Catalog 2002: Varco L.P.: pp. 159, 177, 2002.

PCT Int'l Search Report: PCT/GB2005/050193: 3 pp.: mailed Jan. 24, 2006.

PCT Written Opinion: PCT/GB2005/050193: 5 pp.: mailed Jan. 24, 2006.

WELLBORE RIG ELEVATOR SYSTEMS

BACKGROUND OF THE INVENTION

1. Field of the Invention

The present invention is related to: elevator systems, elevators for wellbore operations, and method of their use.

2. Description of Related Art

Wellbore operations often involve tubulars (e.g. pipe, tubing, and casing) and strings of tubulars which are run into and out of boreholes. Elevators are used in such operations to hold, lift, and lower tubulars.

Several typical prior art elevators have heavy hinged clamps attached to a hook and traveling block by bail-like arms, or "bails". Elevators often may have one or more doors which close around a tubular. There are single-door and split-door types. One type hinges to open to admit or eject pipe. In hoisting a joint of drill pipe, the elevators are latched onto the pipe just below the tool joint (coupling) which prevents the drill pipe from slipping through the elevator. In lifting casing or tubing, the sections of such tubulars either have an upset end, or they are joined together with an enlarged collar. When the elevator is in a closed position, i.e., when the one or two doors are closed shut, the internal diameter of the elevator is less than the outer diameter of the end of the enlarged tool joint, upset, or collar, preventing the tubular from slipping through the elevator.

In many methods used in handling very large pipe, each section of pipe is picked up from a horizontal or non-vertical position and swung to a vertical position for stabbing into the connection of the assembled tubular string. Certain prior art elevators are placed on the pipe and pivot to orient an elevator throat opening downward with the door or doors swinging on hinge(s). The doors on a large elevator, which must be closed around the pipe, may weigh several hundred pounds. An elevator with door(s) needs clearance for the door(s) to swing in an arc under the pipe being engaged. The pipe has to be elevated, or clearance otherwise provided, for such swinging doors.

"Non-slip" prior art elevators have generally been constructed with doors (generally, one or two) which open to allow the insertion or removal of the tubulars; doors which traditionally are heavy, slow in operation, difficult to handle and can present a considerable safety hazard to the operator. With very heavy tubulars, for example, large casing, the tubular is initially in a horizontal or non-vertical position, laying in place on or near the floor beneath a derrick. The hinged door elevator is lowered near the point of attachment to the tubular. The door or doors, which may weigh several hundred pounds, much then be opened to allow the elevator to be placed over the tubular. Because the door or doors must close around the tubular, the tubular end around which the elevator is located is often above the derrick floor.

SUMMARY OF THE PRESENT INVENTION

The present invention teaches an elevator with an elevator body, an open throat in the body; a door pivotably connected to the body; and a latch apparatus on the door which latches onto a lockbar on the body. A locking mechanism locks the door shut. In one particular aspect, the present invention discloses an elevator including: an elevator body for releasably supporting a tubular, the elevator body having two opposed ends and an elevator opening in the body, a tubular passable through the elevator opening; a door pivotably mounted to the body for selectively closing off the elevator opening; a lock bar on the elevator body; door latch apparatus on the door including a movable member to selectively and releasably latch onto the lockbar, and locking apparatus for selectively locking the door in position.

In certain aspects, such an elevator has a locking mechanism which locks the door shut following latching of the door. Optionally, one or more compression springs urges part of the locking mechanism into a locking configuration to hold the latch apparatus in a latched position and to selectively lock the door in position.

In certain aspects, a handle projecting from the door and/or a handle projecting from a link or bail supporting the elevator facilitate elevator opening and closing operations. The present invention provides a link or bail with a handle formed integrally thereof or releasably attached thereto for facilitating operations and for facilitating operation of an elevator according to the present invention.

In certain aspects, both the latch mechanism and the locking mechanism are primary load bearing structures.

The present invention also provides methods for using an elevator according to the present invention.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
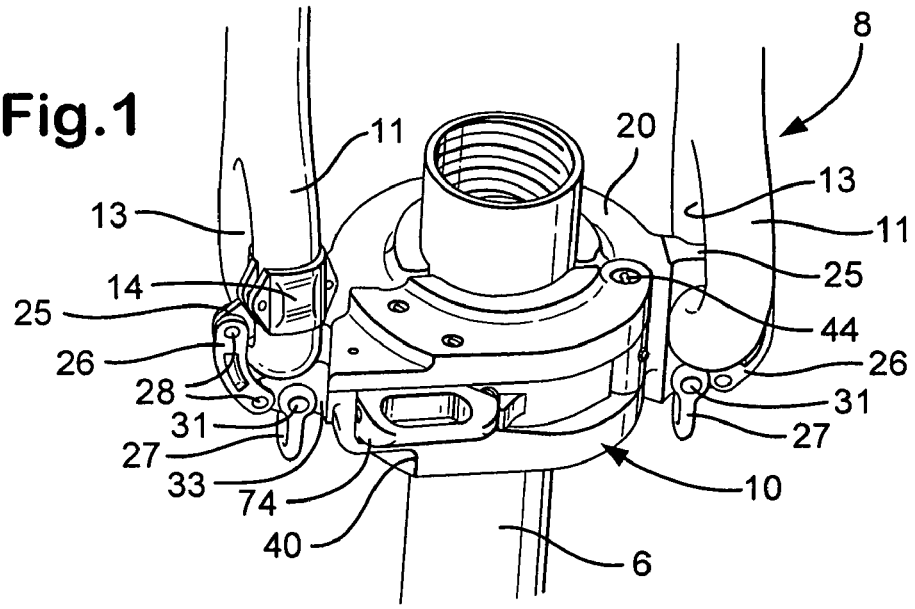
FIG. 1 is a perspective view of an elevator system according to the present invention.
Figure 2:
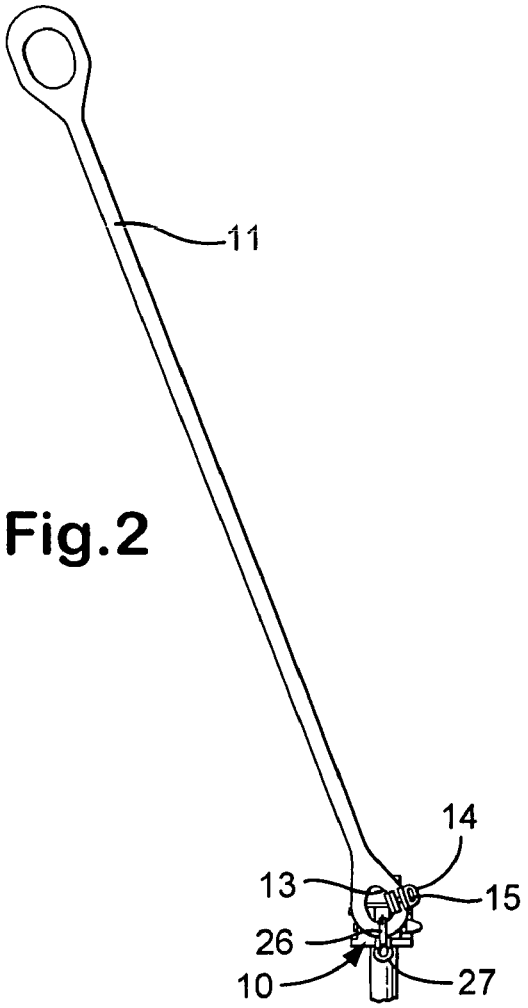
FIG. 2 is a side view of the system of FIG. 1.
Figure 3:
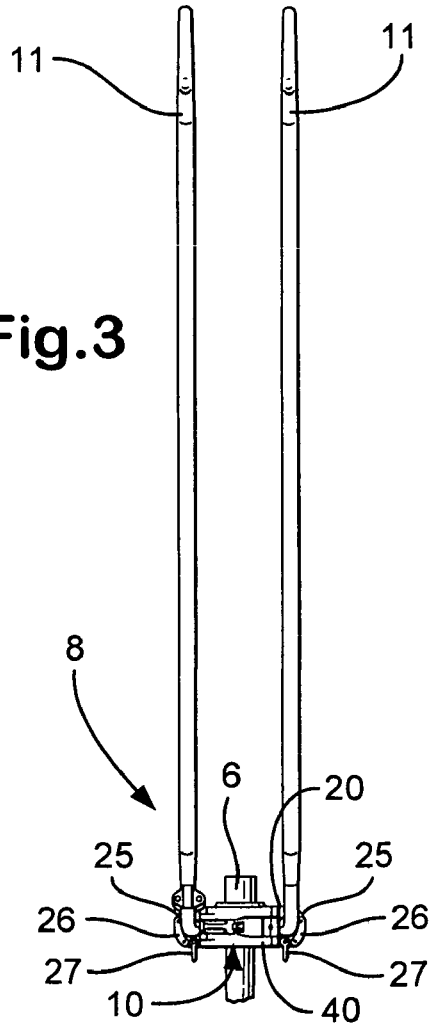
FIG. 3 is a front view of the system of FIG. 1.
Figure 4:
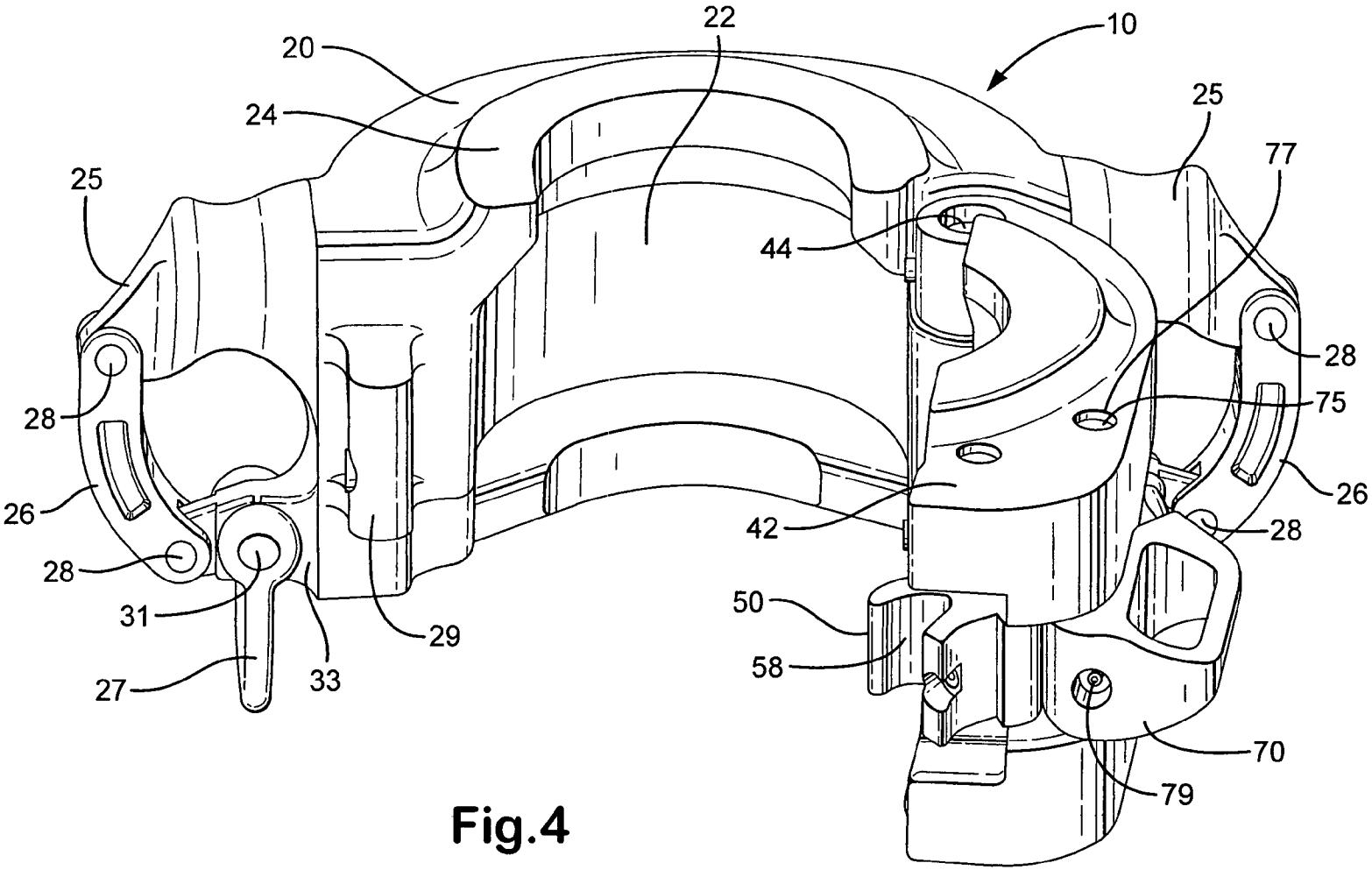
FIG. 4 is a perspective view of an elevator according to the present invention.
Figure 5:
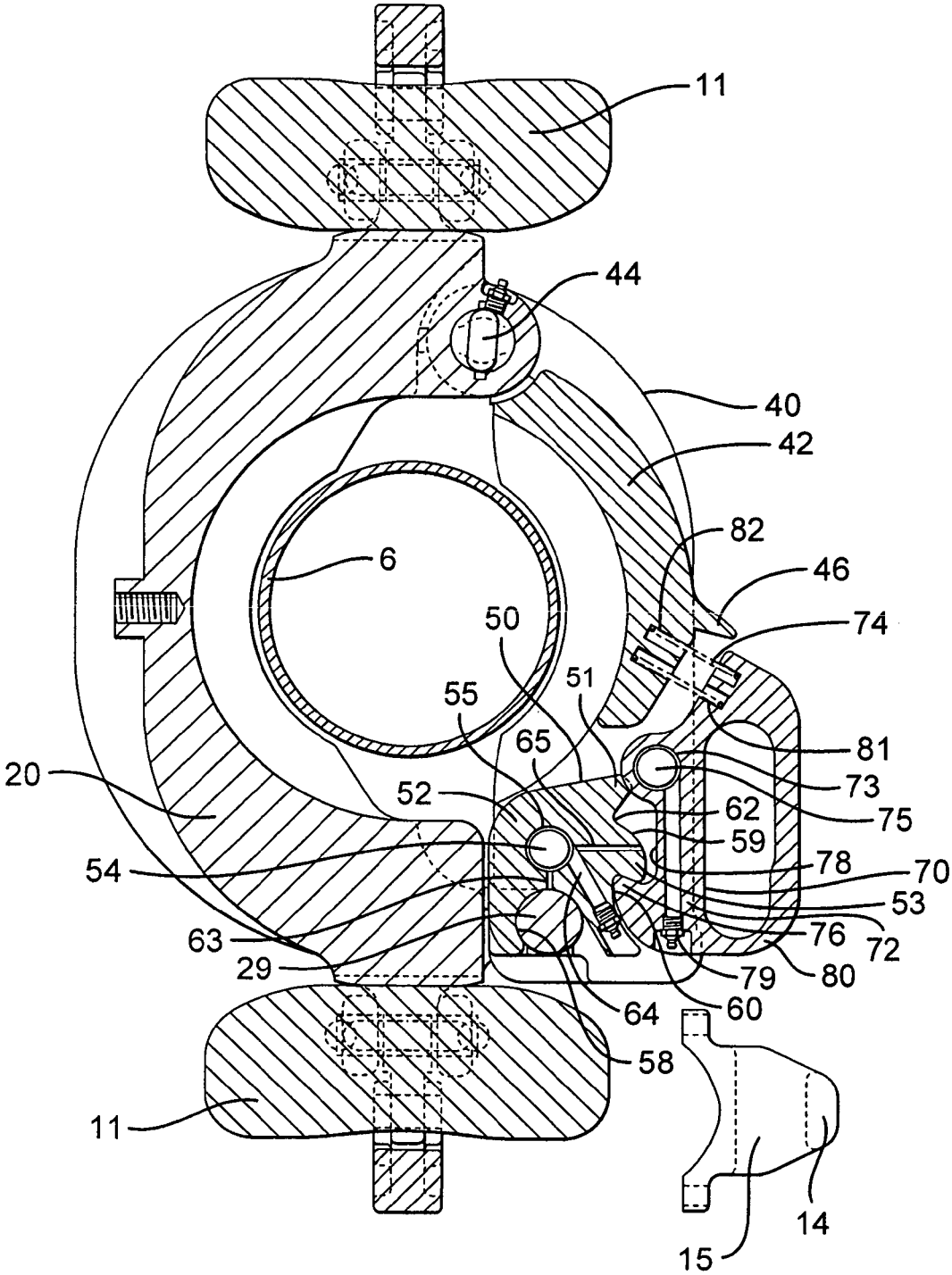
FIG. 5 is a cross-section view of the elevator of FIG. 4.

FIGS. 1-6 show an elevator system 8 which has an elevator 10 according to the present invention supported by bails 11. Openings 13 in the bottom of the bails 11 encircle eyes 25 projecting from sides of a body 20 of the elevator 10. Eye latches 26, pinned to the eyes 25 with pins 28 are movable to permit the bails 11 to be connected to the eyes. Optional lower links 27 are on sides of the body 20, movably connected with pins 31 to projections 33 of the body 20. Using appropriate bails, links, or other supports another item or apparatus, (e.g., but not limited to, an elevator, a single joint elevator, a pipe gripper or a torque head can be suspended from the body 20.

A door 40 is movably connected to the body 20 with a pin 44 so that the door is movable to open and close-off a pathway for a tubular (e.g. a tubular 6) into and out of a throat 22. Optionally, a ridge 24 for shouldering a tubular projects up from the body 20. Optionally, a solid projection or a handle 14 with an optional opening 15 is connected to or formed integrally of one of the bails 11 to provide a structure which can be held or pushed-off from moving the door 40. It is within the scope of this invention to provide such a projection or handle on both bails 11, on any known bail, and on any known support link.

A handle 80 projects from and is formed integrally of a body 72 of a locking apparatus 70 of the door 40. The locking apparatus 70 pivots on a shaft 75 which extends through a hole 73 in the body 72 and holes 77 (one shown in FIG. 4) in the body 42. A compression spring 74 with one end in a recess 75 in the body 72 and the other end in a recess 82 in the body 42 urges the handle 80 away form a lip 46 of the door 40. The handle 80 may, optionally, be a separate item releasably connected to the body 72. It is within the scope of the present invention to provide a handle 80 on any known link or bail.

The locking apparatus 70 is positioned for selective interaction with a latch 50 which is movable to engage and disengage a lockbar 29 connected to and projecting from the body 20. The latch 50 rotates about a shaft 54 which extends through holes 45 (top one shown, FIG. 4; bottom hole beneath top hole) in the body 42 and through a hole 55 through a latch body 52.

The latch 50 is rotatable so that a lip 51 and lockbar recess 58 are movable to selectively encircle or release the lockbar 29. The handle 80 is movable so that a lip 76 projecting from the body 72 can enter a handle lip recess 60 in the body 52 of the latch 50 to lock the latch in position. The handle 80 is also movable so that the lip 76 can enter and reside in a second handle lip recess 62 to releasably hold the latch 50 in a position suitable for initially engaging the lock bar 29 upon appropriate movement of the door 20. The lock may have a grease nipple (add grease nipple to one of the drawings) from which channels 63, 64, and 65 provide grease to parts of the apparatus, e.g. the shaft 54 and adjacent parts. A grease nipple 79 is used to apply grease to the shaft 75. A handle recess 78 is located for receipt therein of a latch body lip 53 and co-acting surfaces of this lip 53 and the handle lip 76 are angled (e.g. a negative angle of seven degrees providing a locking function) so that the lip 76 (and thus the handle 80) can move with respect to the latch body lip 53. The lip 76 can move along a curved surface 59 of the lip 53. The recess 62 is between the lip 53 and a lip 51 and is sized in such a way that it does not pass the lip 76 to overcome further rotating of the latch 50 (see position of FIG. 6) and so that rotation of the latch 50 is not impeded by the lip 76 once the handle 80 is moved away from the latch 50 to free the latch from the lockbar 29, permitting the latch 50 to rotate away from engagement with the lockbar 29.

Figure 6:
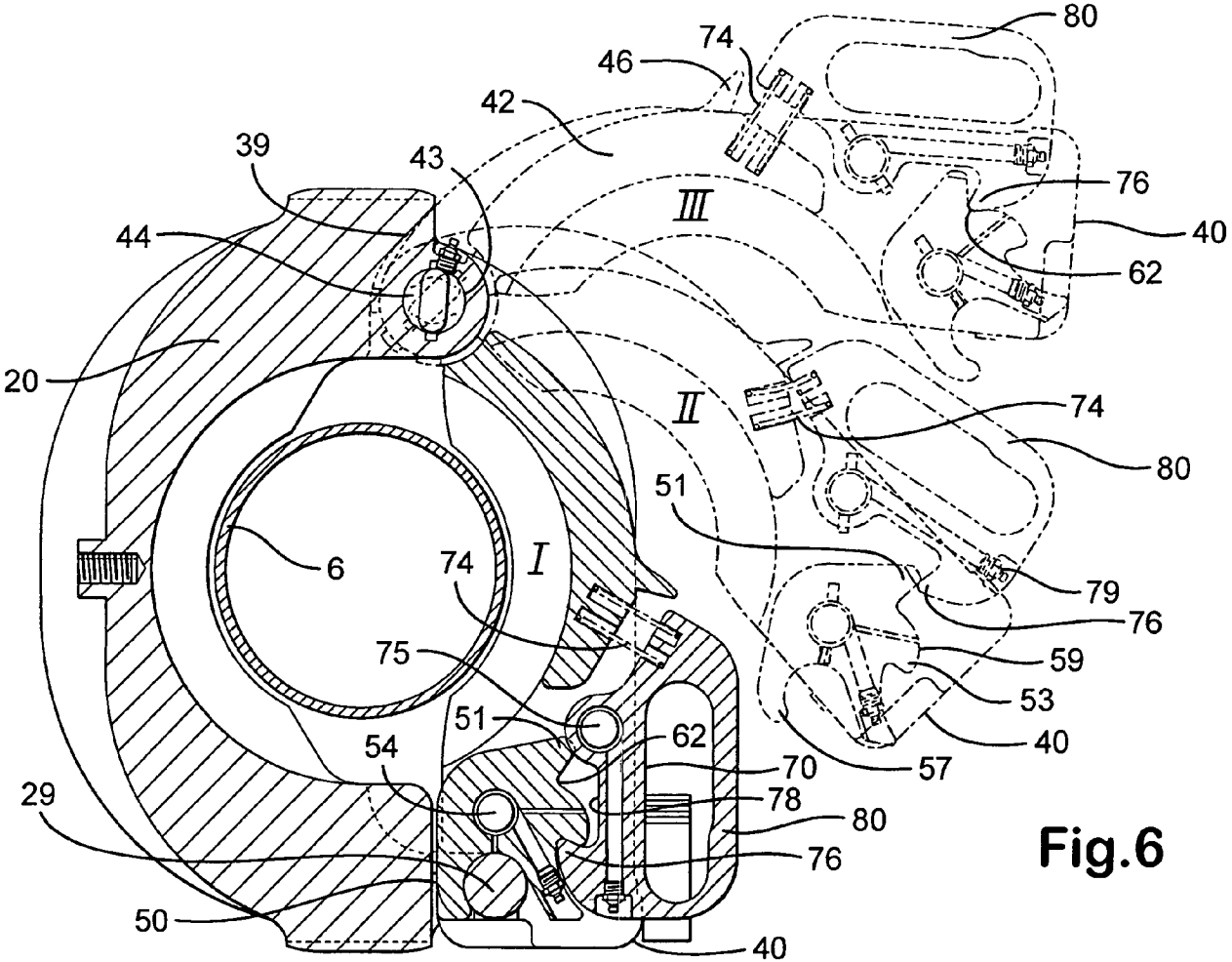
FIG. 6 is a cross-section view of the elevator of FIG. 4 showing various positions for its door.

FIG. 6 shows several positions, I, II, III, of the door 20 in various stages of operation.

In position I, the door 40 is latched and locked. The recess 58 is around the lockbar 29 and the lip 76 of the handle 80 is held in the recess 60 by the force of the spring 74. Two springs 74 may be used, one above the other.

To open the door 40, to begin to move it to position II, the handle 80 is pulled, moving it against the spring 74, until an end 86 of the handle abuts the body 42. A lip 46 inhibits items such as wirelines or cables from entering the space between the door 40 and the handle 80. Movement of the handle 80 releases the lip 76 from the latch recess 60, releasing the locking apparatus 70 from the latch 50 so that the latch 50 can rotate. Once the handle 80 is free of the latch 50, further pulling on the handle 80 pulls the door 40 away from the body 20 and also results in the rotation of the latch 50 with respect to the lockbar 29 and the disengagement of the lockbar 29 from the latch 50. After this, the door 40 is moved to position II with the lip 76 contacting the lip 51

(this contact with the lip 51 assists in disengaging the latch 50 from the lockbar 29 and to overcome further rotation of the latch 50). The lip 51 moves to abut the lip 76 to stop rotation of the latch 50.

When the handle 80 is pulled, in position I, against the force of the spring 74, this action loads the spring 74 which tries to urge the handle 80 back to the position of position I. This force maintains the lip 76 of the handle 80 against the lip 51 of the latch 50 (as shown in position II).

As shown in position III, the door 40 is open and an end part thereof has moved to abut and be stopped by door endstop 39. The spring 74 has moved the lip 76 into the recess 62. The door 40 is open and a tubular, e.g. the tubular 6, can be moved into and out of the body 20 of the elevator 10.

FIGS. 7-12 show an elevator 100 according to the present invention, with a body 102 and a door 40*a* (like the door 40) like the elevators previously described herein according to the present invention and like the elevator 8 described above. The elevator 100 is shown supporting a tubular 150. Bails 110 are similar to the bails as described above. The bails 110 have a body 112 with an upper opening 114 and a lower opening 116 through which passes part of eyes 125 (like the eyes 25 described above).

A handle 140 is releasably secured around part of the body 112. The handle 140 is located so that personnel operating the elevator 100 can grip the handle 140 to provide stability and to facilitate operation of the elevator 140. Additionally such a handle connected as shown or, according to the present invention, connected at any desirable location on a link or bail can facilitate manipulation, movement, and/or transport of a bail or link.

As shown in FIGS. 12-19 the handle 140 has two parts, part 142 and part 144 which are held around part of the bail body 112 by bolts, screws, or fasteners passing through holes 142*a*, 144*a* and 142*b*, 144*b* (bolts 140*a* as shown in FIGS. 13-19). The handle 140 may be connected to the bail 110 by any suitable known item, device, apparatus, substance (e.g., but not limited to, epoxy adhesive) or method. Optionally the part 142 alone is bolted directly or otherwise secured to the body of the bail 112 (with or without the portions with the holes 142*a*, 142*b*), e.g., but not limited to, with one or more bolts or screws through the part 142 into the bail 112, or formed integrally thereof. An optional opening 146 through the handle facilitates gripping of the handle. The opening 146 may be deleted (as may be the opening 15 of the handle 14, FIG. 2).

Optionally, an elevator according to the present invention may have a verification lock which provides a visual indication that the elevator is latched and locked and which provides further structure to maintain the elevator in a locked configuration. In one embodiment a verification lock has a portion which projects against a part of the handle (e.g. the handle 14 or 80) and is rotatable with respect thereto. To open an elevator in a locked and latched position as in position I, FIG. 6, the verification lock is rotated clockwise (e.g. about sixty degrees) to permit opening of the elevator. Upon closing of the elevator and latching and locking thereof, the verification lock is turned (e.g. about sixty degrees) counterclockwise to lock it in place, preventing movement of the handle.

Figure 18:
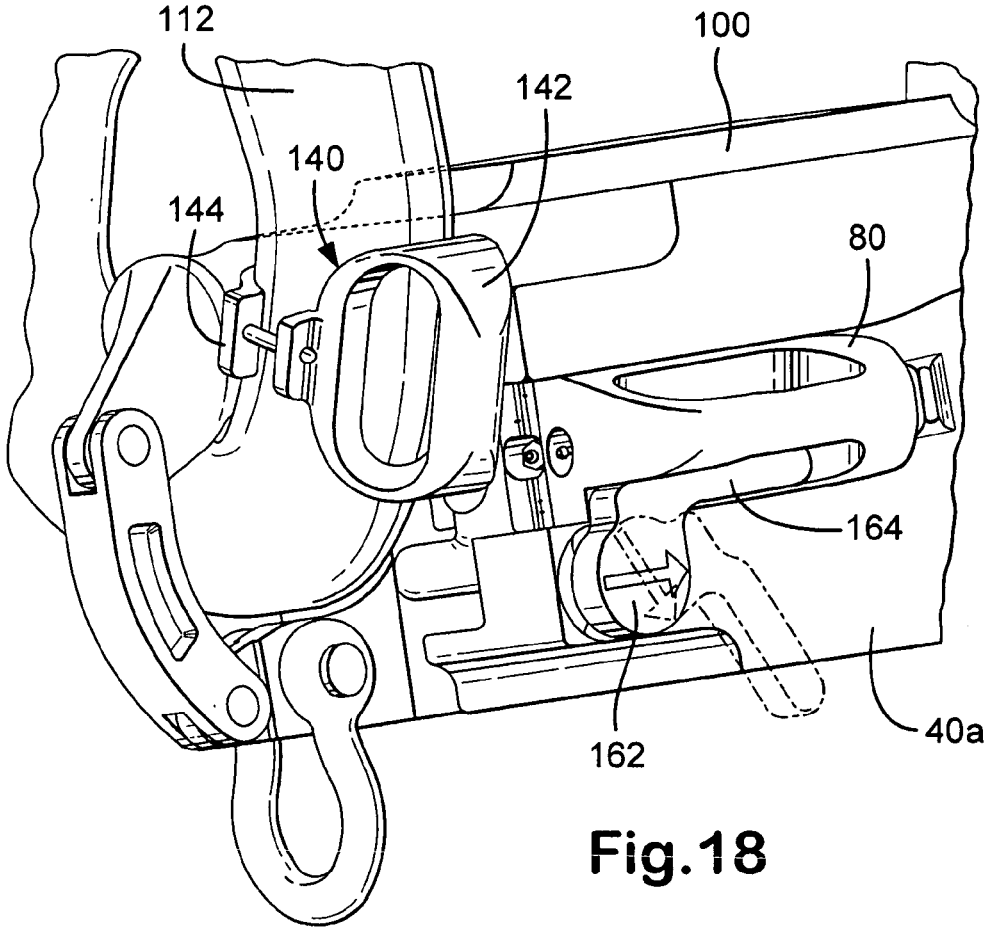
FIG. 18 is a front view of the mechanism of FIG. 16.
Figure 19:
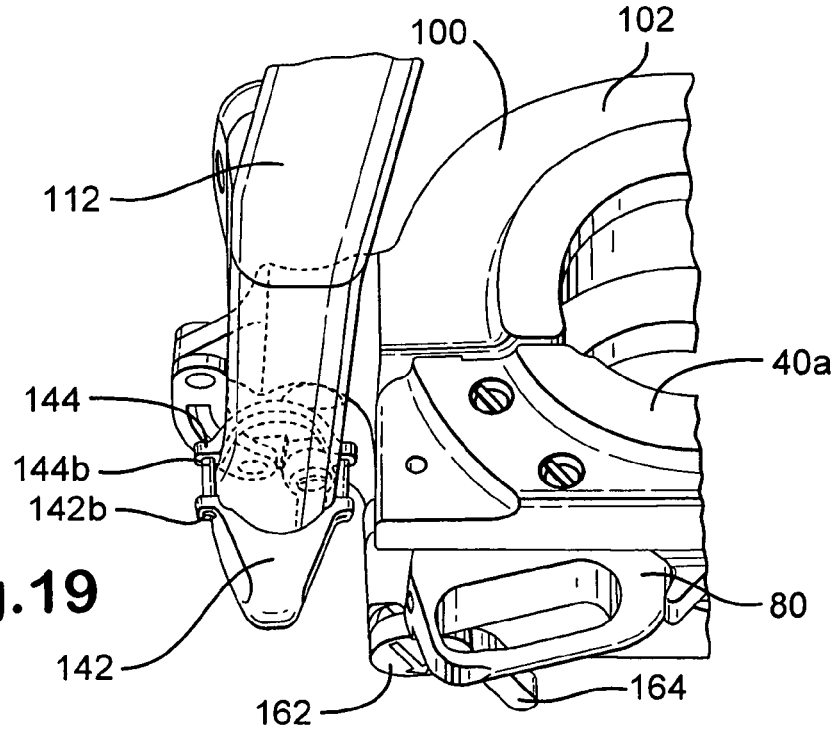
FIG. 19 is a top view of the mechanism of FIG. 16.

FIGS. 16-19 illustrate one embodiment of a verification lock apparatus 160 according to the present invention. Such an apparatus may be used adjacent a movable handle of any elevator. The apparatus 160 has a body 162 with a handle 164 and a shaft 166 projecting from the body 162. The shaft 166 extends into a hole 168 in the door 40*a* and is brought under spring load tension by a spring 176 adjacent a ring 177 and retained in place by a retainer pin 172. The pin 172 through the door 40*a* and through a hole 174 in the shaft 166 releasably holds the body 162 in position. The spring 176 holds the body 162 in a desired position (door-locked or door-unlockable) with a cam projection 178 in place in a space 186 adjacent portion 182 of the door 40*a*. Turning the handle 164 clockwise moves the cam projection 178 into a space 188 adjacent a projection 184 of the door 40*a* so that the handle 164 can be held in a door-unlockable position—see, e.g. FIG. 19. FIG. 18 shows the handle 164 in a door-locked position with the handle 164 abutting a lower portion 80*a* of the handle 80. The door-unlockable position is illustrated in outline in FIG. 18. Manually moving the handle 164 provides sufficient force to overcome the spring 176 and move the cam projection 178 into or out of the spaces 186 or 188.

Figure 7:
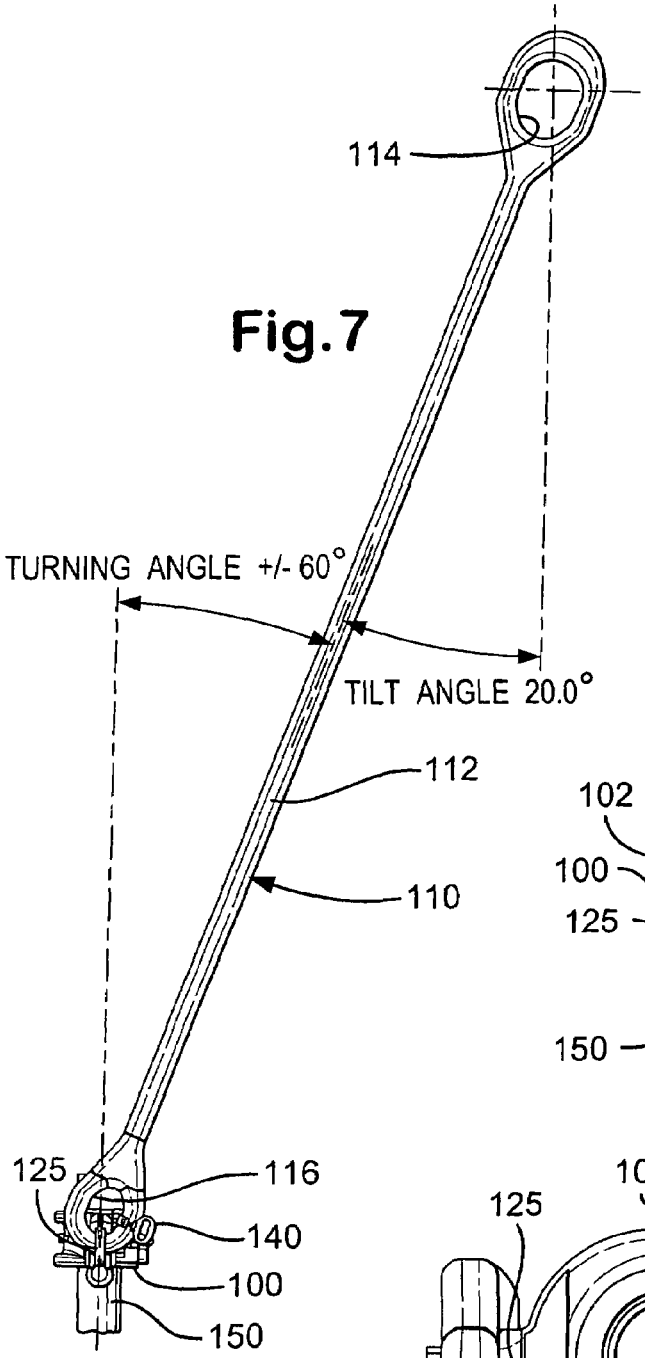
FIG. 7 is a side view of an elevator according to the present invention with links according to the present invention.
Figure 8:
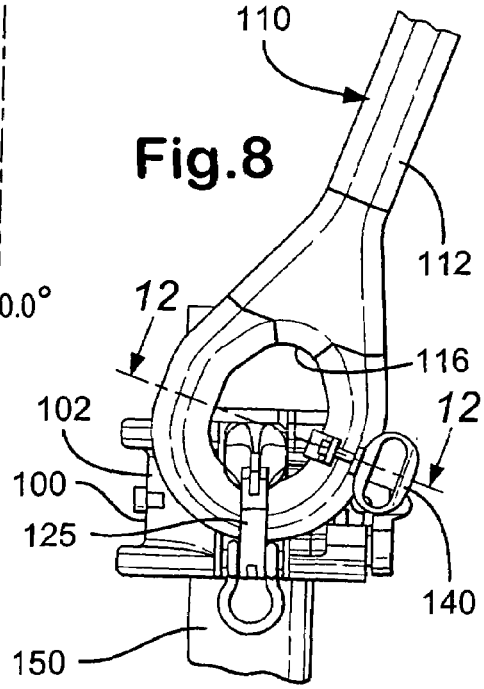
FIG. 8 is an enlargement of part of the apparatus shown in FIG. 7.
Figure 9:
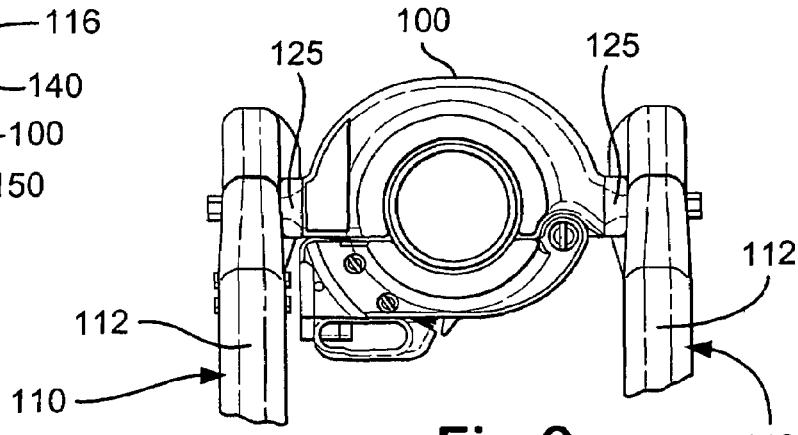
FIG. 9 is a top view of part of the apparatus shown in FIG. 7.
Figure 10:
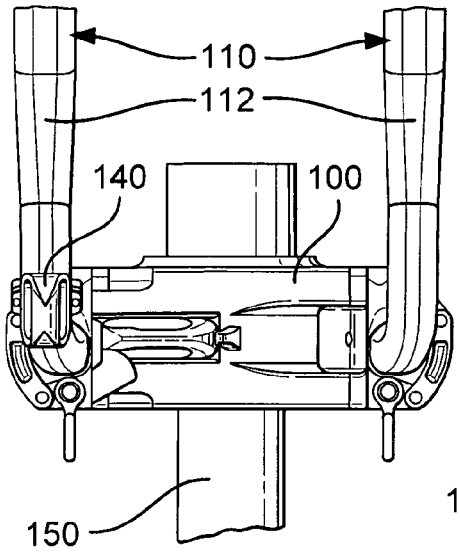
FIG. 10 is a front view of part of the apparatus shown in FIG. 7.
Figure 11:
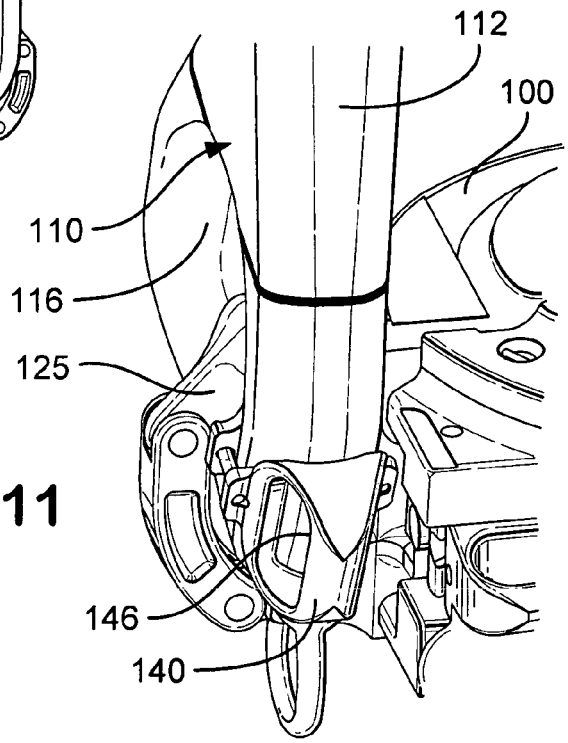
FIG. 11 is a front perspective view of part of the apparatus shown in FIG. 7.
Figure 12:
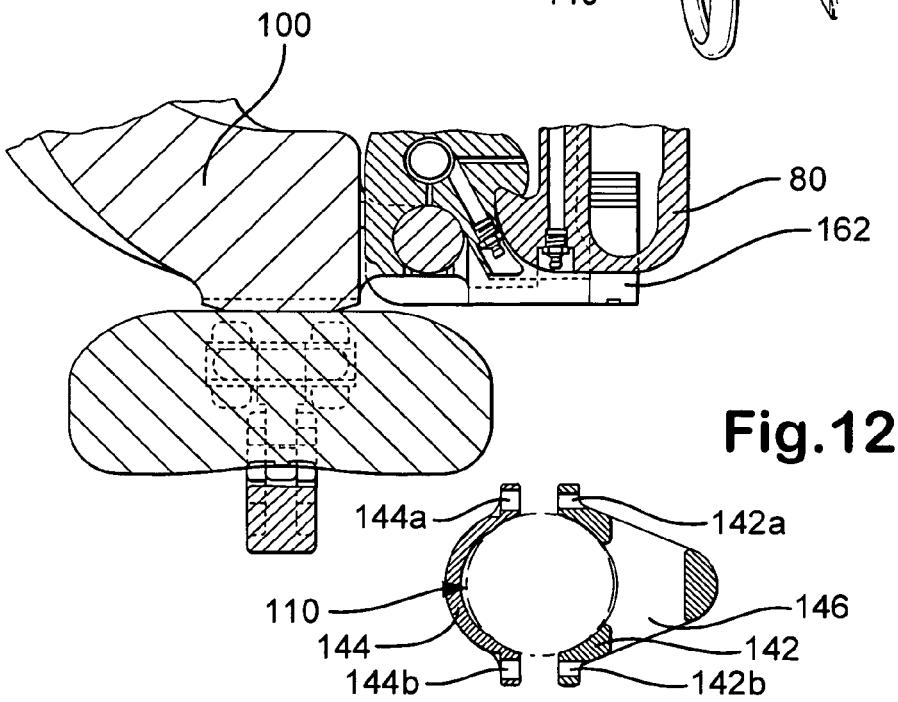
FIG. 12 is a cross-section view along line 12-12 of FIG. 8.
Figure 13:
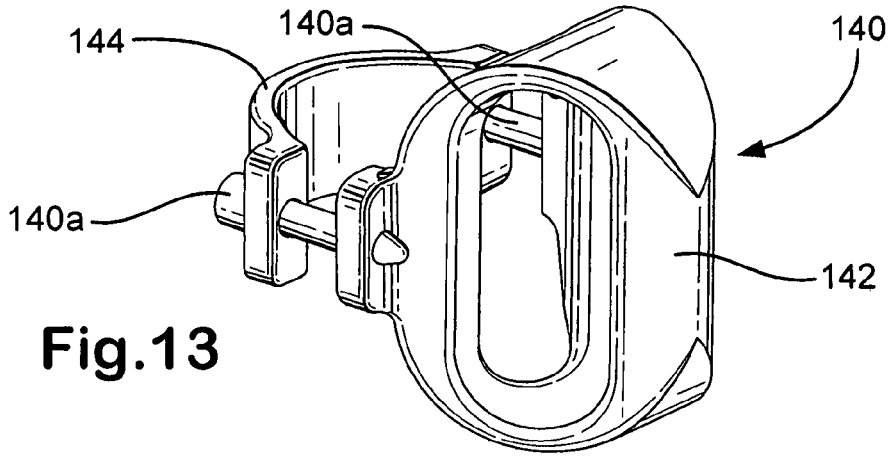
FIG. 13 is a perspective view of a handle for a link according to the present invention.
Figure 14:
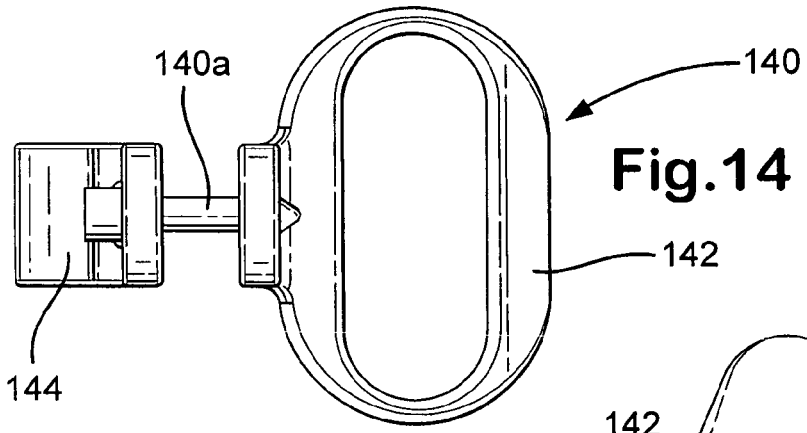
FIG. 14 is a top view of the handle of FIG. 13.
Figure 15:
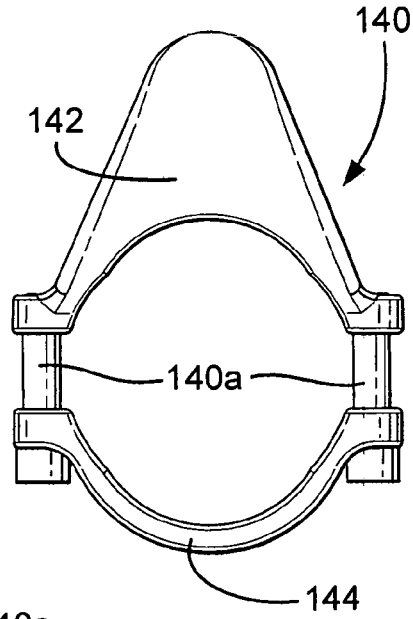
FIG. 15 is a bottom view of the handle of FIG. 13.
Figure 17:
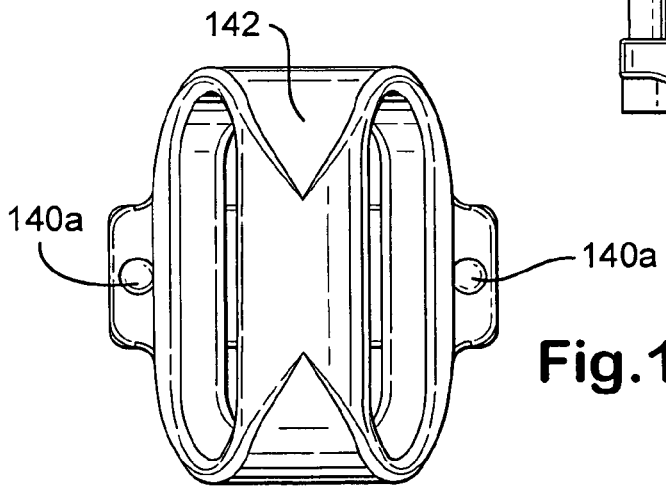
FIG. 17 is a side view of the handle of FIG. 13.
Figure 16:
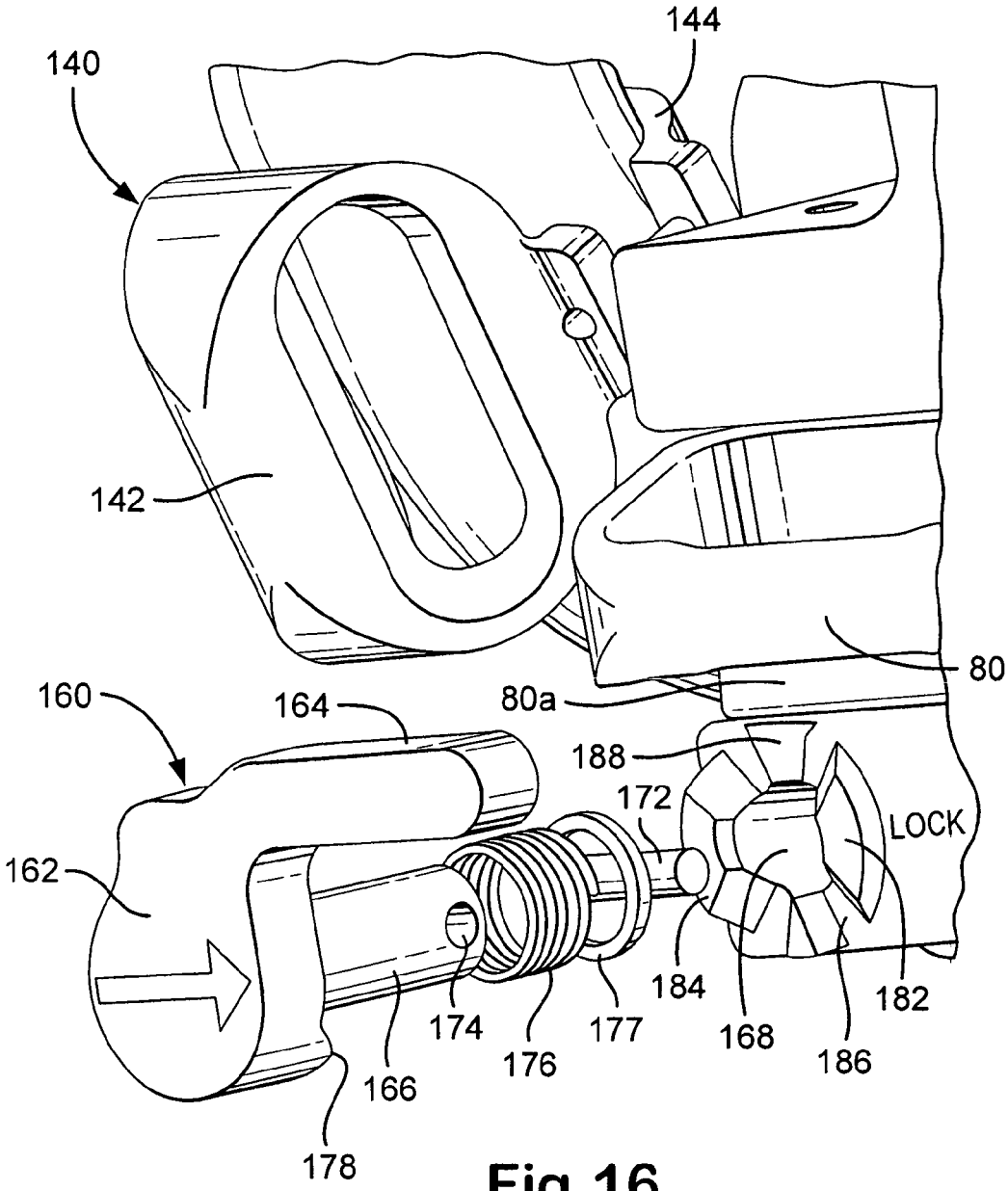
FIG. 16 is a perspective view, partially exploded, of a verification lock mechanism according to the present invention for an elevator according to the present invention.

In one particular embodiment, e.g. as shown in one aspect in FIG. 7, an elevator according to the present invention has a turning angle of plus-or-minus 60 degrees "turning angle" is the angle between a vertical centerline of the shaft of a support link and the vertical center line of the elevator and measures the rotation of the elevator with respect to the link. As shown, an elevator according to the present invention may have a tilt angle of 20 degrees or more. "Tilt angle" is the out-of-vertical position of the link center line and measures the rotation of the link with respect to "the world."

The present invention, therefore, provides in some, but not in necessarily all, embodiments an elevator with an elevator body for releasably supporting a tubular, the elevator body having two opposed ends and an elevator opening in the body, a tubular passable through the elevator opening, a door pivotably mounted to the body for selectively closing off the elevator opening, a lock bar on the elevator body, door latch apparatus on the door including a movable member to selectively and releasably latch onto the lockbar, and locking apparatus for selectively locking the door in position. Such an elevator may have one or some, in any possible combination, of the following: the door latch apparatus having a latch body, a recess in the latch body for selectively receiving and selectively disengaging from the lockbar, and the latch body pivotably mounted to the door; the locking apparatus having a lock body movably mounted to the door for co-action with the latch body, the lock body selectively movable to hold the latch body in place in engagement with the lockbar, and the lock body selectively movable to move the latch body out of engagement with the lockbar to unlatch the door for pivoting movement of the door to permit a tubular to pass through the elevator opening; the latch body having a first latch recess therein, the lock body having a lock body projection projecting therefrom, and the first latch recess located for releasably receiving the lock body projection so that with the lock body projection in the first latch recess the door is locked; spring apparatus connected to and between the door and the locking apparatus to bias the locking apparatus into a locking position; the locking apparatus having handle apparatus on the lock body for facilitating gripping of the lock body and movement thereof; a lip on the door for inhibiting movement of an item into a space between the door and the locking apparatus; the elevator body having two opposed support eyes projecting from the elevator body, the support eyes for receiving a part of a support bail; two support bails, one each of the two support bails having a portion passing through a corresponding one of the support eyes; handle apparatus on at least one of the two support bails, the handle apparatus sized, located, and configured for manual handling by personnel; the handle apparatus located on the at least one of the two support bails to facilitate movement of the door of the elevator by personnel; the handle apparatus formed integrally of the at least one bail; the handle apparatus releasably secured to a portion of the at least one bail; verification apparatus for releasably maintaining the locking apparatus in a door-locked position; the verification apparatus including a primary body movably mounted to the door, a primary handle projecting from the body, the primary handle movable to an abutment position to abut part of the locking apparatus and movable out of said abutment position; and/or spring apparatus biased between the door and the primary body for releasably holding the verification apparatus in a door-locked or a door-unlockable position.

The present invention, therefore, provides in some, but not in necessarily all, embodiments a method for gripping a tubular, the method including positioning an elevator adjacent a tubular, the elevator as any disclosed herein according to the present invention, and releasing a door latch apparatus to unlatch the door, releasing a locking apparatus to unlock the door, moving the door to expose one elevator opening, moving the tubular into the elevator, and closing the door, latching the door shut, and locking the door. Such an elevator may have one or some, in any possible combination, of the following: wherein the elevator includes verification apparatus for releasably maintaining the locking apparatus in a door-locked position, the method including releasably maintaining with the verification apparatus the door in a door-locked position; wherein the elevator includes the verification apparatus including a primary body movably mounted to the door, a primary handle projecting from the body, the primary handle movable to an abutment position to abut part of the locking apparatus and movable out of said abutment position, the method including moving the primary handle to abut part of the door to maintain the door in a door-locked position; and/or wherein the elevator includes spring apparatus biased between the door and the primary body for releasably holding the verification apparatus in a door-locked or a door-unlockable position, the method including releasably holding the verification apparatus in position.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. An elevator comprising an elevator body for releasably supporting a tubular, the elevator body having two opposed ends and an elevator opening in the body, a tubular passable through the elevator opening, a door pivotably mounted to the body for selectively closing off the elevator opening, a lock bar on the elevator body, door latch apparatus on the door including a movable member to selectively and releasably latch onto the lockbar, locking apparatus for selectively locking the door in position, wherein the door latch apparatus comprises a latch body, a recess in the latch body for selectively receiving and selectively disengaging from the lockbar, the latch body pivotably mounted to the door, wherein the locking apparatus comprises a lock body movably mounted to the door for co-action with the latch body, the lock body selectively movable to hold the latch body in place in engagement with the lockbar, and the lock body selectively movable to move the latch body out of engagement with the lockbar to unlatch the door for pivoting movement of the door to permit a tubular to pass through the elevator opening.

2. The elevator of claim 1 wherein the latch body has a first latch recess therein, the lock body has a lock body projection projecting therefrom, and the first latch recess located for releasably receiving the lock body projection so that with the lock body projection in the first latch recess the door is locked.

3. The elevator of claim 1 further comprising spring apparatus connected to and between the door and the locking apparatus to bias the locking apparatus into a locking position.

4. The elevator of claim 1 wherein the locking apparatus further comprises handle apparatus on the lock body for facilitating gripping of the lock body and movement thereof.

5. The elevator of claim 4 further comprising a lip on the door for inhibiting movement of an item into a space between the door and the locking apparatus.

6. The elevator of claim 1 further comprising the elevator body having two opposed support eyes projecting from the elevator body, the support eyes for receiving a part of a support bail.

7. The elevator of claim 6 further comprising two support bails, one each of the two support bails having a portion passing through a corresponding one of the support eyes.

8. The elevator of claim 7 further comprising handle apparatus on at least one of the two support bails.

9. The elevator of claim 8 wherein the handle apparatus is located on the at least one of the two support bails to facilitate movement of the door of the elevator by personnel.

10. The elevator of claim 8 wherein the handle apparatus is formed integrally of the at least one bail.

11. The elevator of claim 8 wherein the handle apparatus is releasably secured to a portion of the at least one bail.

12. The elevator of claim 1 further comprising verification apparatus for releasably maintaining the locking apparatus in a door-locked position.

13. The elevator of claim 12 further comprising the verification apparatus including a primary body movably mounted to the door, a primary handle projecting from the body, the primary handle movable to an abutment position to abut part of the locking apparatus and movable out of said abutment position.

14. The elevator of claim 13 further comprising spring apparatus biased between the door and the primary body for releasably holding the verification apparatus in a door-locked or a door-unlockable position.

15. A method for gripping a tubular, the method comprising positioning an elevator adjacent a tubular, the elevator comprising an elevator body for releasably supporting a tubular, the elevator body having two opposed ends and an elevator opening in the body, a tubular passable through the elevator opening, a door pivotably mounted to the body for selectively closing off the elevator opening, a lock bar on the elevator body, door latch apparatus on the door including a movable member to selectively and releasably latch onto the lockbar, and locking apparatus for selectively locking the door in position, wherein the door latch apparatus comprises a latch body, a recess in the latch body for selectively receiving and selectively disengaging from the lockbar, the latch body pivotably mounted to the door, wherein the locking apparatus comprises a lock body movably mounted to the door for co-action with the latch body, the lock body selectively movable to hold the latch body in place in engagement with the lockbar, and the lock body selectively movable to move the latch body out of engagement with the lockbar to unlatch the door for pivoting movement of the door to permit a tubular to pass through the elevator opening, and releasing the door latch apparatus to unlatch the door, releasing the locking apparatus to unlock the door, moving the door to expose one elevator opening, moving the tubular into the elevator, and closing the door, latching the door shut, and locking the door.

16. The method of claim 15 wherein the elevator includes verification apparatus for releasably maintaining the locking apparatus in a door-locked position, the method further comprising releasably maintaining with the verification apparatus the door in a door-locked position.

17. The method of claim 15 wherein the elevator includes the verification apparatus including a primary body movably mounted to the door, a primary handle projecting from the body, the primary handle movable to an abutment position to abut part of the locking apparatus and movable out of said abutment position, the method further comprising moving the primary handle to abut part of the door to maintain the door in a door-locked position.

18. The method of claim 15 wherein the elevator includes spring apparatus biased between the door and the primary body for releasably holding the verification apparatus in a door-locked or a door-unlockable position, the method further comprising releasably holding the verification apparatus in position.

* * * * *